United States Patent [19]

Schneider

[11] Patent Number: 4,554,978

[45] Date of Patent: Nov. 26, 1985

[54] QUICK ATTACH TRACTOR MOUNTING ASSEMBLY FOR AGRICULTURAL DOZER AND LOADER IMPLEMENT

[75] Inventor: David E. Schneider, Great Bend, Kans.

[73] Assignee: Great Bend Manufacturing Co., Inc., Great Bend, Kans.

[21] Appl. No.: 593,885

[22] Filed: Mar. 27, 1984

[51] Int. Cl.[4] ..... E02F 3/76

[52] U.S. Cl. ..... 172/247; 37/117.5; 172/274; 172/817; 172/275; 414/686

[58] Field of Search ..... 172/272, 274, 275, 817; 37/117.5; 414/715, 717, 686

[56] References Cited

U.S. PATENT DOCUMENTS

| | | | |
|---|---|---|---|
| 2,659,572 | 11/1953 | Steer | 172/817 |
| 2,878,598 | 3/1959 | Pilch | 172/275 |
| 3,131,823 | 5/1964 | Foster | 172/274 |
| 3,255,903 | 6/1966 | Lofgren | 172/275 |
| 3,439,752 | 4/1969 | Coontz | 172/817 |
| 3,749,180 | 7/1973 | Coontz | 172/817 |
| 3,800,882 | 4/1974 | Werts | 172/817 |

OTHER PUBLICATIONS

Coontz, Front Mount Dozer Blade Model 1750, advertising brochure of Hart-Carter Mendota, Ill.

Great Bend Loader Operators Manual, Models 2024, 2524, 3424, Great Bend Mfg. Co. Inc., Great Bend, KA published 1981.

*Primary Examiner*—Richard J. Johnson

*Attorney, Agent, or Firm*—Schmidt, Johnson, Hovey & Williams

[57] ABSTRACT

A frame assembly for mounting on a tractor is provided which is designed for quickly and easily attaching different types of implements thereto without the necessity of frame modification or other time-consuming tractor alterations. Advantageously, the frame assembly includes a pair of elongated rails respectively secured to opposed sides of a tractor, along with a bracket assembly secured to the underside of the tractor adjacent the tractor drawbar structure. Each of the alternately mountable implements includes a mounting assembly having a pair of elongated spaced apart channel arms which are operable for slidingly engaging respective mounting rails. In use the implements are stationarily positioned independently of the tractor, and attachment of the implements is simply a matter of driving the tractor forward with the tractor-mounted rails located to slide into engagement with the implement channel arms. The channel arms and rails are then secured by means aligned, apertured coupling structure and quick-connect pins. The dozer blade implement is provided with an elongated lower central beam which extends beneath the tractor for interconnection to the bracket to provide a sturdy and stable blade during scraping operations.

6 Claims, 11 Drawing Figures

QUICK ATTACH TRACTOR MOUNTING ASSEMBLY FOR AGRICULTURAL DOZER AND LOADER IMPLEMENT

BACKGROUND OF THE INVENTION

1. Field of the Invention

The present invention is broadly concerned with tractor mounted implements and a mounting assembly for such implements permitting quick, alternate attachment of different types of implements to a given tractor. More particularly, it is concerned with an overall implement mounting system which makes use of elongated, laterally spaced apart, fore and aft extending, tractor mounted rails along with a plurality of implements each including a pair of elongated connection arms for releasable securement to the corresponding rails, in order to provide a quick attach and detach mounting structure for different implements.

2. Description of the Prior Art

As those involved in the agricultural industry are aware, there is often a need for using various types of material handling implements such as hay forks, front end loaders, or dozer blades in work around a farm. However, these different types of implements are usually not needed often enough to justify the expense of purchasing an individual machine specifically designed to perform each function. For example, it might be desirable for a farmer to have at his disposal a front end loader to perform various types of jobs, but the need is not great enough to justify purchase of a dedicated front end loader. Further, most farmers have already made a large investment in tractors for their farming operations.

Rather than purchase individual machines to perform needed different functions, and because of the great investment already made in tractors, it is generally desirable to provide different types of readily attachable implements which can be easily mounted to a tractor as the need arises. From a cost standpoint, it is more desirable to purchase a front end loader implement which can be mounted to a tractor when desired, with the loader being detachable when use thereof is not desired. That is, with the implement detached, the tractor is field ready to perform other farming operations.

Different types of implements and mounting assemblies have been devised in the past which have recognized the need for detachable tractor-mounted implements, but these have not met the need for a truly universal system permitting ready changeovers between different types of implements. That is to say, the structural and load characteristics of a dozer blade are greatly different than those of a front end loader for example, and accordingly a mounting assembly adequate for the dozer may be totally inappropriate for the loader. Accordingly, there is a real and unsatisfied need in the art for a universal mounting assembly adapted for installation on a tractor, along with plural mated implements designed for alternative, easy securement to the mounting assembly. Obviously, to be successful such a system must reconcile the seemingly incompatible design and load characteristics of the different implements without undue cost or complexity in the mounting structure.

SUMMARY OF THE INVENTION

The present invention addresses the problems outlined above, and provides an assembly adapted to be affixed to a tractor and operable for quickly and alternately mounting at least first and second, different types of implements to the tractor. The assembly broadly includes a pair of elongated rails designed for securement to the forward end of the tractor on opposed sides thereof and extending fore and aft, along with bracket means adapted for securement to the underside of the tractor adjacent the rearward end thereof, and specifically in a position closer to the rearward end of the tractor than the forward ends of the rails.

The invention also comprehends first and second, different implements each including a material handling element, a pair of elongated, laterally spaced apart connecting arms oriented for straddling the forward end of the tractor and engaging the assembly rails, and means operatively connecting the material handling element to the connecting arms. Finally, means is provided for alternately and releasably coupling the first and second implements to at least certain portions of the assembly, including structure for releasably securing each of the connecting arms to a corresponding tractor mounted rail.

In preferred forms, the connecting arms are in the form of respective channels which telescopically receive the corresponding tractor mounted rails, with the rails and arms being appropriately apertured for receiving quick-connect pins.

One of the implements forming a part of the invention is preferably a loader including a material handling bucket. In this case, the bucket is mounted on a pair of lift arms for raising and lowering of the bucket, with the lift arms in turn being pivotally attached to the connecting arms. In addition, corresponding piston and cylinder assemblies are provided between the connecting arm structure and the boom arms in order to permit selective operation of the loader unit.

The other implement particularly useful in the context of the invention is a dozer which includes an elongated dozer blade. In this case, however, the dozer implement includes an elongated connection leg positioned between and below the connecting arms, with the rearmost end of the connection leg being adapted for securement to the lower bracket means.

In another aspect of the invention, an improved tractor mounted dozer is provided which includes a dozer blade and means for mounting the blade onto a tractor. The mounting means includes a pair of elongated, laterally spaced apart connecting arms oriented for straddling and operatively engaging the forward end of the tractor. Blade-supporting structure is also provided which includes a front cross assembly having a depending connection element. The front cross assembly is secured to the tractor, and means is provided for positioning of the depending connection element at any one of a number of vertical positions. The blade-supporting structure further includes a rear push assembly in the form of an elongated beam extending rearwardly for connection adjacent the rear end of the tractor, and means for releasably coupling the lower end of the depending element to the forward end of the rear push assembly. Finally, the dozer includes operating means coupling the blade and blade-supporting structure for pivoting movement of the blade about respective upright horizontal axes. In this fashion, the dozer can be mounted to a variety of tractors (especially those including front wheel drive assist) which require tilting of the loader.

DESCRIPTION OF THE PREFERRED EMBODIMENT

Figure 2:
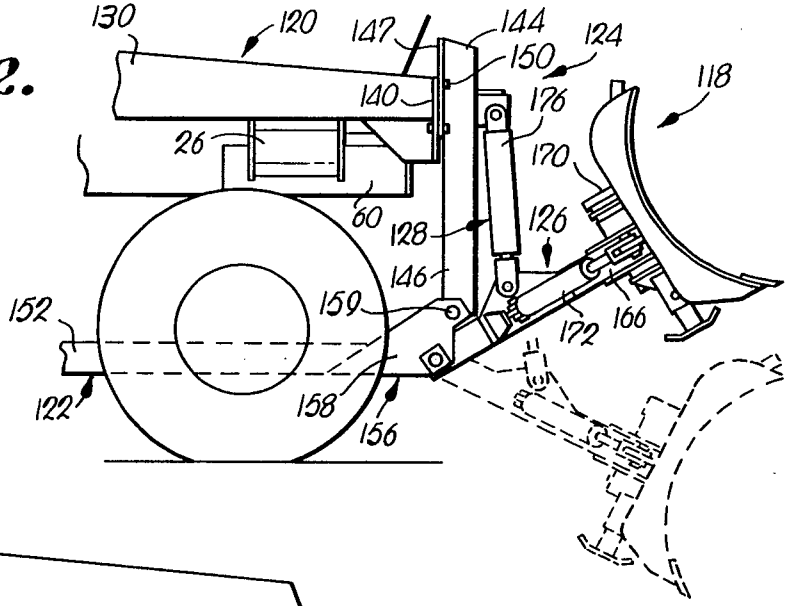
FIG. 2 is a fragmentary view of the forward end of the apparatus depicted in FIG. 1, illustrating the up-and-down pivotal movement of the dozer blade.

Turning now to the drawings, the present invention includes a mounting assembly 10 designed to be affixed to a tractor 12 of any conventional design in order to quickly and alternately mount first and second, different types of implements to the tractor. For purposes of illustration, a dozer implement 14, and a loader implement 16 are depicted in the drawings. As noted, each of the different implements 14, 16 is alternately and releasably attachable to the tractor 12 through the medium of assembly 10, without the need for time consuming modifications to the tractor.

In more detail, mounting assembly 10 includes a rail sub-assembly 18 (see FIG. 4), along with a rear bracket 20. The sub-assembly 18 has a pair of elongated metallic rails 22, 24, each having a forward, inwardly extending bracing segment 26, 28. In addition, each of the rails 22, 24 includes an obliquely oriented guide plate 30, 32 secured to the forwardmost ends of the respective rails.

Again referring to FIG. 4, it will be seen that each of the rails 22, 24 includes a connection bracket 34, 36 at the rear end thereof. Each of the connection brackets is in the form of a generally U-shaped body 38, 40, having an outermost apertured wall or side plate 42, 44. In addition, each bracket 34, 36 includes a crosspiece 46, 48 which extends between the upstanding walls of the corresponding bodies 38, 40, and supports an apertured tang 50, 52. The respective tangs are in spaced relationship to the corresponding outboard side plates 42, 44, with the tang and sidewall apertures being in alignment.

Figure 1:
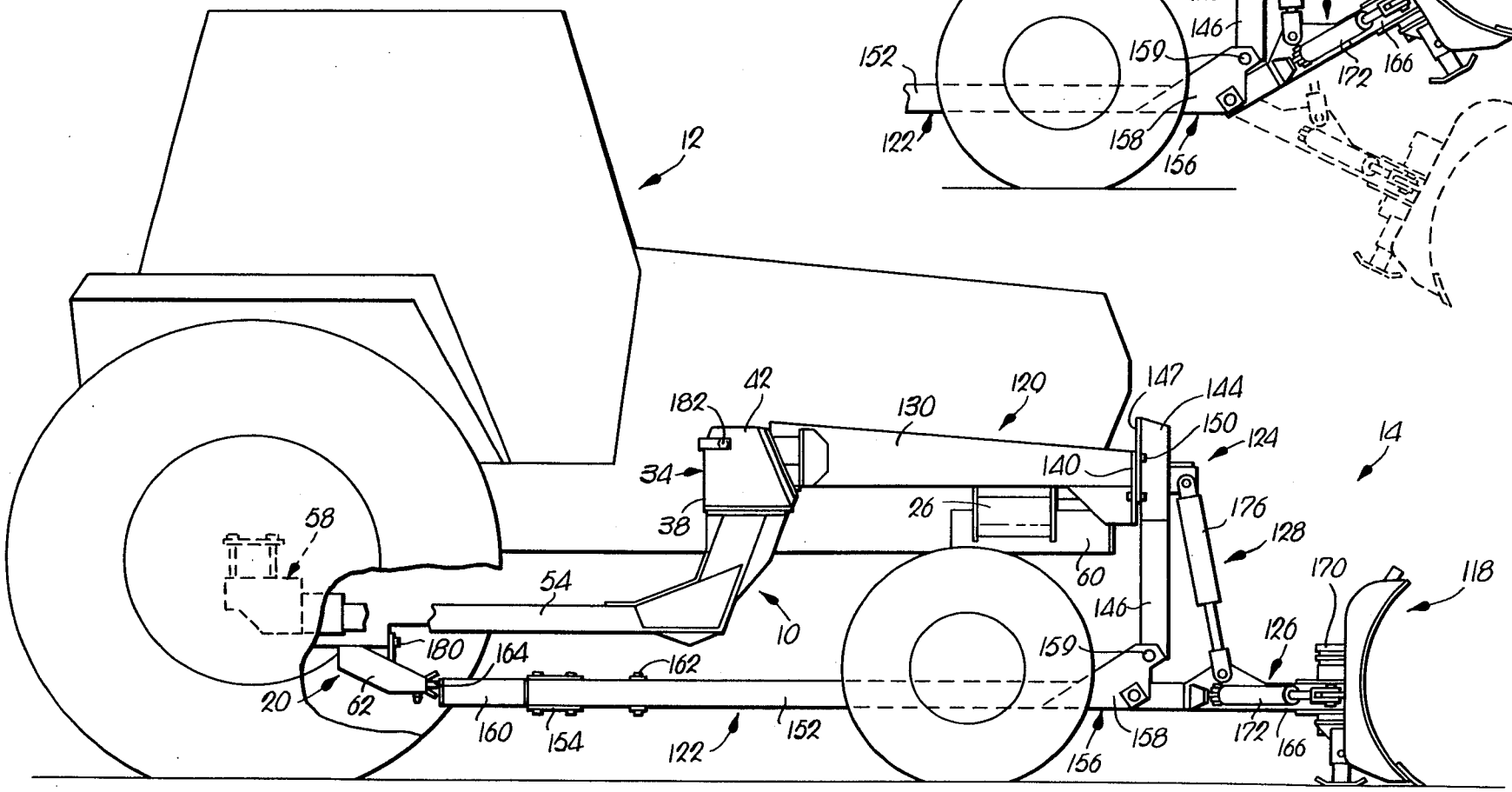
FIG. 1 is a side view with parts broken away for clarity of a conventional tractor having the implement-mounting assembly of the invention affixed thereto, along with the improved dozer of the invention.

The rail sub-assembly 18 also includes, for each rail 22, 24, a downwardly and rearwardly extending bracing portion 54, 56. As best seen in FIG. 1, each of the bracing portions 54, 56 is secured to the underside of a corresponding U-shaped body 38, 40, and extends downwardly and then rearwardly therefrom to a rearmost connection end, preferably in the form of bracket structure 58 designed to be secured to the rear axle of tractor 12.

The overall rail sub-assembly 18 is secured to tractor 12 by means of a central, forward connection box or bracket 60 which is affixed to the forward end of tractor 12 by bolts or any other conventional means. The respective, outwardly extending bracing segments 26 secured to the rails 22, 24 are in turn affixed to connection box 60, and the endmost bracket structures 58 forming a part of the portions 54, 56 are secured to the rear axle of the tractor.

Figure 9:
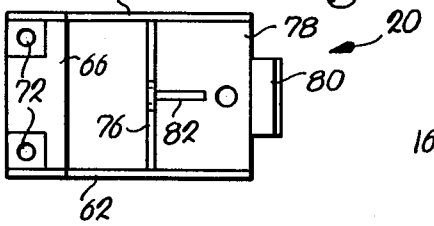
FIG. 9 is a plan view of the rear tractor-mounted bracket forming a part of the mounting assembly for the dozer implement.
Figure 10:
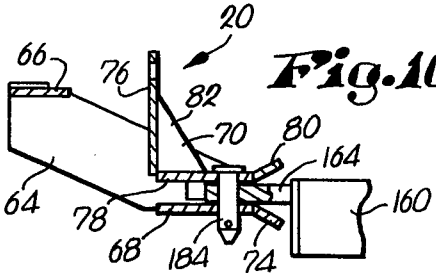
FIG. 10 is a fragmentary sectional view illustrating the pin connection between the bracket illustrated in FIG. 9, and the rearmost end of the rear push assembly of the dozer.

The rear bracket 20 (see FIGS. 1, 9 and 10) is designed to be fixedly secured by bolts or other conventional means to the rear end of tractor 12, typically adjacent the drawbar of the tractor. The bracket 20 includes a pair of downwardly and forwardly extending, laterally spaced apart sidewalls 62, 64 which are interconnected by means of upper and lower cross plates 66, 68, and by intermediate wall structure 70. Upper cross plate 66 is apertured as at 72 in order to permit secure attachment of the bracket 20 to the tractor, whereas lower cross plate 68 is centrally apertured and includes a forwardmost oblique entry lip 74. The intermediate wall structure includes an upright apertured wall 76, a horizontally extending, centrally apertured wall 78 including an obliquely oriented entry lip 80, and a triangular bracing piece 82. The aperture provided in upright wall 76 is likewise used for purposes of affixing bracket 20 to the tractor 12, whereas the apertures provided in the vertically spaced apart, horizontally extending walls 68, 78, are used for purposes of implement coupling, as will be more fully explained hereinafter.

Figures 3, 4, 5:
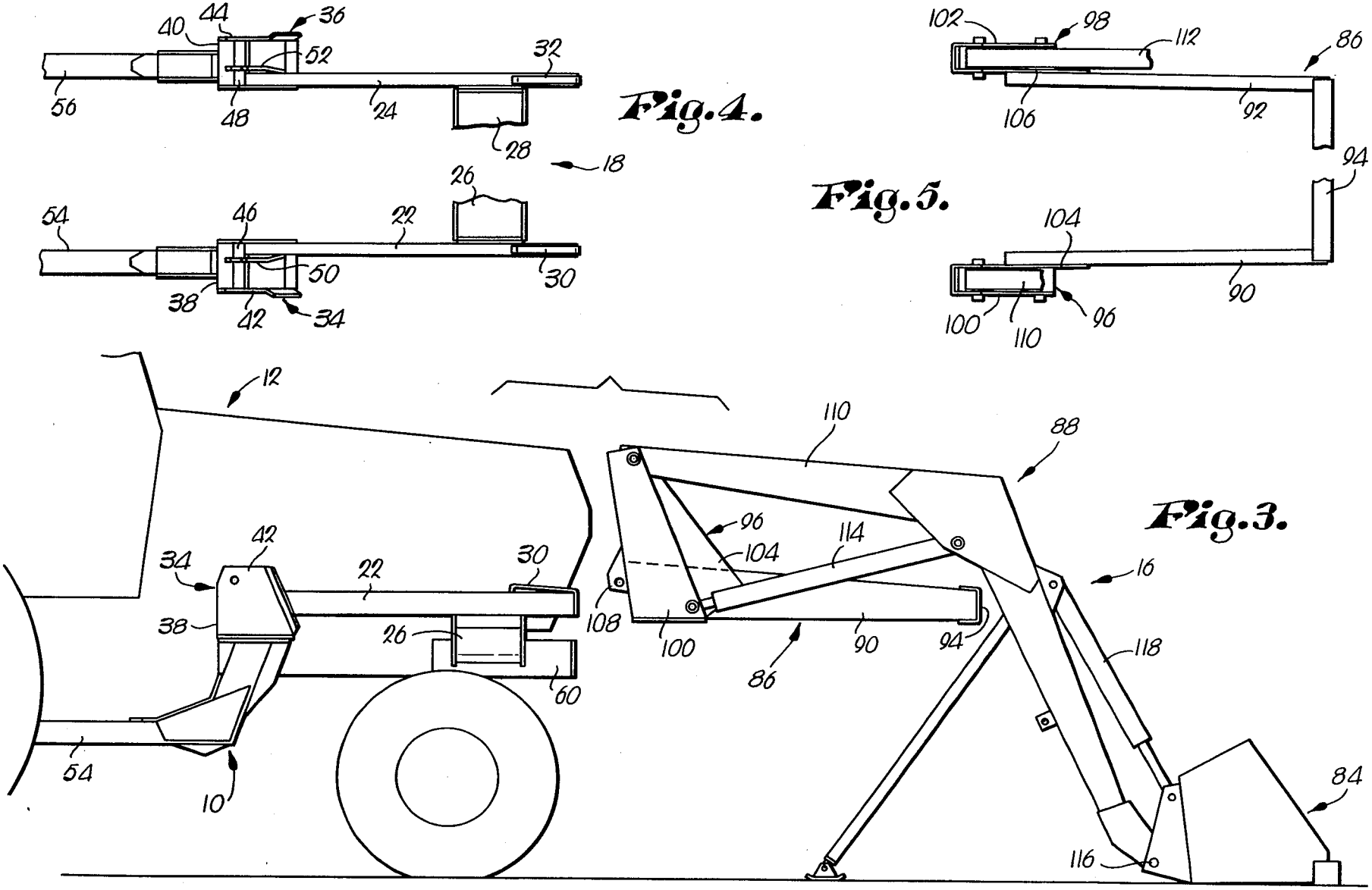
FIG. 3 is a side view illustrating a loader implement in accordance with the invention positioned at rest during a mounting operation wherein the loader is coupled to a tractor.
FIG. 4 is a fragmentary top view illustrating the double rail assembly forming a part of the overall implement mounting assembly adapted for securement to a tractor.
FIG. 5 is a fragmentary top view illustrating the connection arm structure forming a part of the overall loader illustrated in FIG. 3.

Loader implement 16 broadly includes a bucket 84 of conventional design, connection arm structure 86 serving to couple the implement 16 to the tractor 12 through the medium of mounting assembly 10, and lift arm assembly 88 which operatively connects bucket 84 to the connection arm structure 86. In more detail, the connection arm structure 86 includes a pair of elongated, laterally spaced apart connecting arms 90, 92 which are of inwardly opening, channel shaped cross section and diverge from fore to aft as best seen in FIG. 3. The arms 90, 92 are oriented for straddling the forward end of tractor 12 and telescopically receiving and engaging the corresponding connection rails 22, 24. To this end, a forward cross brace 94 extends between and interconnects the arms 90, 92. Each arm 90, 92 is also provided with an upstanding, stationary, forwardly opening connection channel 96, 98 which includes an outboard wall 100, 102, an inboard wall 104, 106 fixedly secured to the corresponding arm 90, 92, and a pair of rearwardly extending apertured connection tangs 108 (see FIG. 3).

The lift arm assembly 88 includes a pair of laterally spaced apart lift arms 110, 112 which are respectively pivotally coupled at the uppermost end of a corresponding connection channel 96, 98. Each of the lift arms 110,

112, includes a forwardly extending section and an oblique, downwardly extending section, as best seen in FIG. 3. In addition, a pair of hydraulically operated piston and cylinder assemblies 114 are respectively pivotally secured within and at the lowermost end of a corresponding connection channel 96, 98, and to the adjacent lift arm 110, 112.

As noted, bucket 84 is of conventional design, and is pivotally mounted as at 116 to the lowermost ends of the arms 110, 112. In addition, a pair of piston and cylinder assemblies 118 are provided for pivoting control of the bucket 84. The assemblies 118 are pivotally connected between the arms 110, 112, and bucket 84, as will be readily appreciated from a study of FIG. 3.

Dozer implement 14 broadly includes a dozer blade 118, connection arm structure 120, a central, rear push assembly 122, a front cross assembly 124, a center push assembly 126, and operating means 128.

Figure 11:
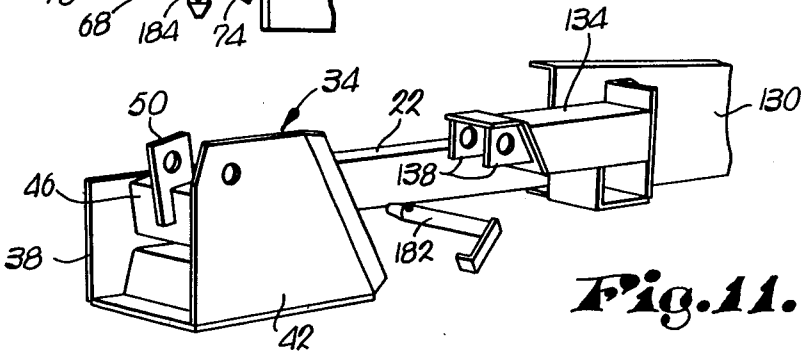
FIG. 11 is a fragmentary perspective view illustrating the telescopic interfitting of one of the tractor-mounted rails, and a corresponding dozer connecting arm.

The arm structure 120 has a pair of elongated, fore and aft extending, inwardly opening, channel shaped connection arms 130, 132. The latter vertically diverge from fore to aft, and include a rearmost connection bracket 134, 136. Each of the brackets includes a pair of laterally spaced apart, apertured tabs 138, as best seen in FIG. 11. The forward end of each arm 130, 132, is provided with a plate 140, 142 having two laterally spaced apart, vertically oriented series of connection apertures therethrough; the importance of this feature will be explained hereinafter.

Figure 8:
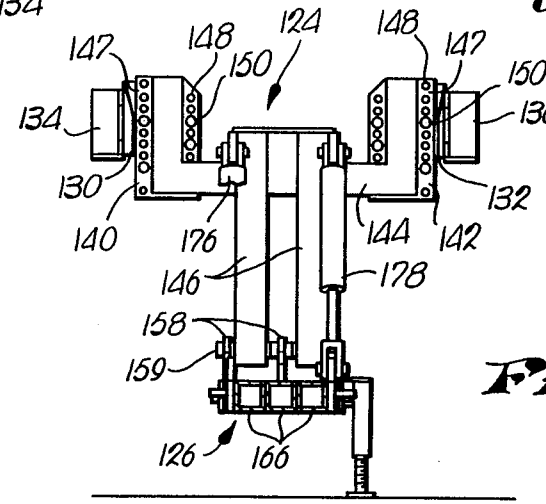
FIG. 8 is a sectional view taken along line 8—8 of FIG. 6 which further illustrates the front cross assembly forming a part of the dozer of FIG. 6.
Figure 7:
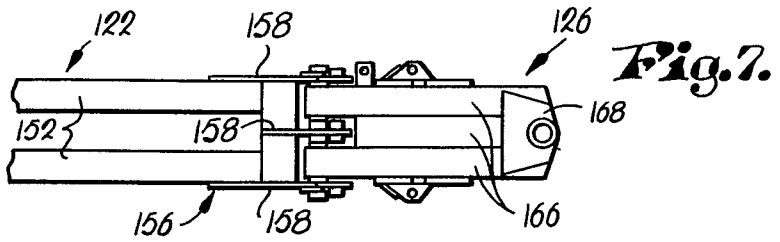
FIG. 7 is a fragmentary top view depicting the forward end of the rear push assembly, and the center push assembly, forming a part of the dozer depicted in FIG. 6.

The front cross assembly 124 includes an upper, generally U-shaped portion 144 and a pair of downwardly extending, laterally spaced apart, depending tubular elements 146. The upstanding legs of portion 144 are provided with laterally extending flanges 147 which are apertured as at 148 along the length thereof and oriented for registration with the apertures provided in the arm plates 140, 142. Connection bolts 150 are employed for securing the front cross assembly 124 to the arms 130, 132, as will be readily appreciated from a study of FIGS. 6 and 8.

The rear push assembly 122 is in the form of an elongated beam extending beneath and between the arms 130, 132. Specifically, the structure 122 includes a pair of laterally spaced apart, elongated metallic tubes 152 interconnected at the rearmost end thereof by means of connection plate 154. The forward ends of the tubes 152 are likewise interconnected by a bracket 156 presenting three laterally spaced apart, apertured upstanding plates 158. Releasable pins 159 are employed for interconnecting the forward end of the assembly 122 to the lowermost end of the tubular elements 146.

The overall structure 122 further includes a central, rearwardly extending, initially adjustable connection tube 160 which is situated between the tubes 152 and extends rearwardly thereof. After initial adjustment of the connection tube 160 as will be described, the latter is fixed in place by means of connector 162. In any event, the connection tube 160 terminates in a rearmost, apertured tang 164 which permits coupling of the rear push assembly 122 to bracket 20 as will be more fully explained.

The center push assembly 126 extends forwardly from rear push assembly 122 and includes three juxtaposed metallic tubes 166. The outboard tubes 166 are pivotally coupled at their lowermost ends to the plates 158, such that the center push assembly 126 can rotate about a horizontal axis relative to the rear push assembly 122 and tractor 12. The forward end of the tubes 126 is interconnected by means of a bracket 168, the latter also supporting a king pin assembly 170 affixed to blade 118, and permitting rotation of the latter about a vertical axis.

Figure 6:
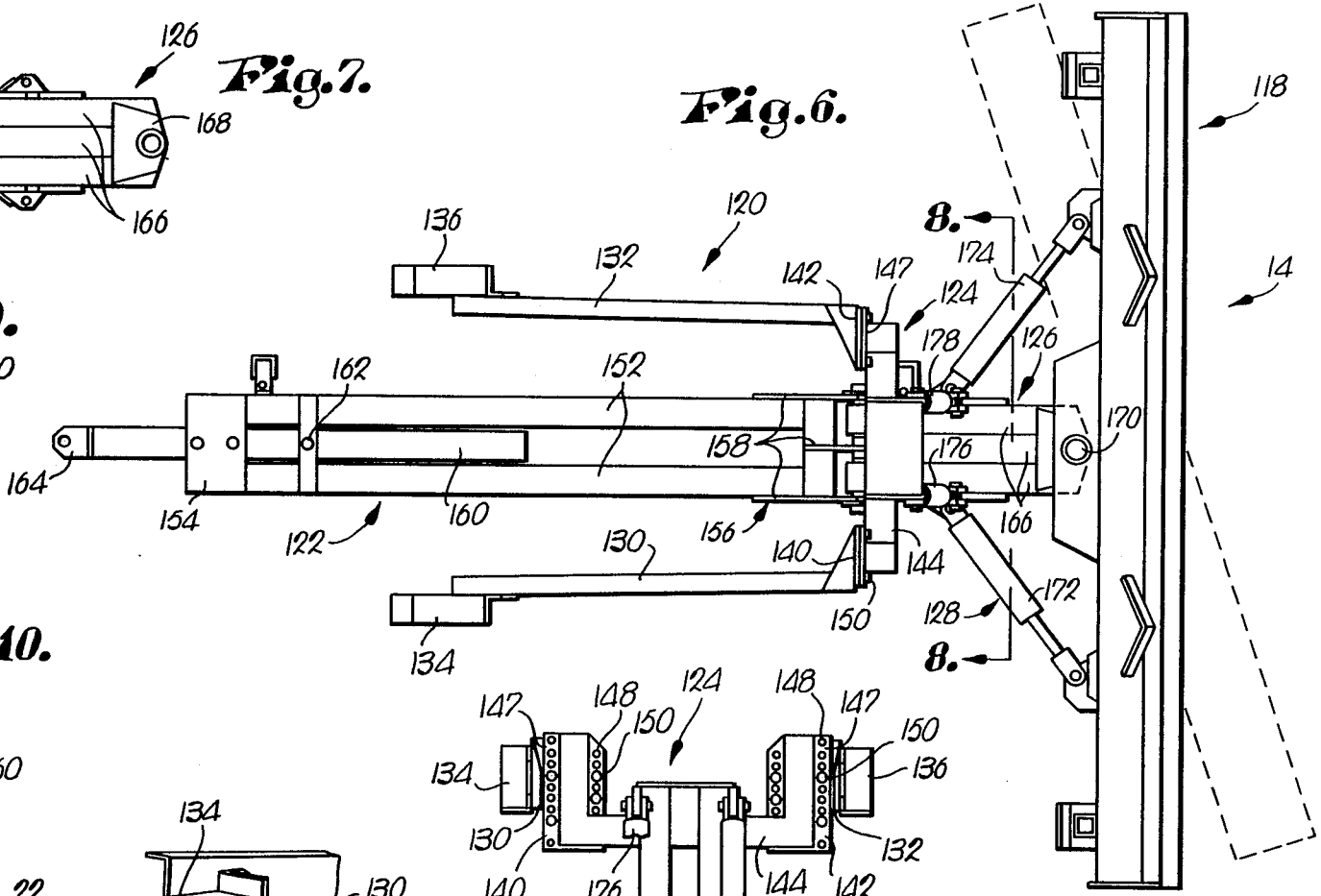
FIG. 6 is a plan view of the dozer in accordance with the invention, and illustrating in phantom the pivoting of the dozer blade about an upright axis.

The operating assembly 128 includes a total of four hydraulically operated piston and cylinder assemblies 172–178. As best seen in FIGS. 1 and 6, the assemblies 172, 174 are interconnected between the outboard tubes 166 of center push assembly 126, and the blade 118; these piston and cylinder assemblies control pivoting movement of the blade about the horizontal axis defined by king pin assembly 170. On the other hand, the assemblies 176, 178, are interconnected between the U-shaped portion 144 of front cross assembly 124, and the outboard tubes 166 of center push assembly 126; these piston and cylinder assemblies control up-and-down movement of the blade 118, i.e., pivoting movement thereof about the pivot axis established between the center push assembly 126 and rear push assembly 122.

The use of the apparatus of the invention should be readily apparent from the foregoing description. Briefly, however, it is first of all necessary to install the mounting assembly 10 to the tractor 12. This involves appropriate connection of the connector box 60 to the forward end of the tractor, followed by securement of the rail sub-assembly 18 thereto. The latter involves connection of the bracing segments 26 to the connector 60, and connection of the bracket structures 58 to the rear axle of the tractor. The bracket 20 is also affixed to an appropriate location at the rear of the tractor, for example to the draw bar or transmission housing of the tractor. For this purpose, bolts 180 are passed through the apertures provided in plates 66, 76, and are connected to the tractor structure.

If the user now seeks to employ the loader implement 16, it is only necessary to position the latter in a stationary orientation as viewed in FIG. 3, and to drive tractor 12 forwardly between the arms 90, 92 of the implement. During this forward motion, the respective rails 22, 24 are slidingly and telescopically received within the corresponding connection arms 90, 92, until the rails bottom out against the forward ends of the arms. In this orientation, the guide plates 30, 32 engage the upper walls of the connecting arms, in order to give a secure frictional fit. In addition, at this point the apertured tangs 108 associated with each of the arms 90, 92 are located between the side plates and tangs 42, 50 and 44, 52 of the brackets 34, 36, with all of the apertures being in substantial alignment. It is then only necessary to insert appropriate quick-connect pins 182 (see FIG. 11) through the aligned apertures, in order to lock the loader implement 16 in place on the tractor. The parking stand of the implement 16 is then properly stowed, and the piston and cylinder assemblies 114, 118 associated with the loader are connected to the hydraulic system of the tractor.

The loader can then be used in the conventional manner, until it is desired to detach the loader from the tractor. This involves merely a reversal of the above outlined connection sequence.

Connection and use of the dozer implement 14 is in most respects similar to that outlined above with respect to the loader. That is to say, the dozer is positioned as illustrated in FIG. 6 and the tractor 12 is merely driven forward between the connection arms 130, 132, until the rails 22, 24, bottom out against the forward ends of the rails. At this point the tabs 138 are received between the plate and tang structure of the respective connection brackets 34, 36, permitting insertion of quick-connect pins as previously described. Moreover, as the tractor is driven forward into the implement, the tang 164 of the lower push assembly 122 passes between the plates 68, 78 of lower bracket 20. At this point, another quick-connect pin 184 is employed to secure the lower push assembly to the rear bracket.

Again, the operating piston and cylinder assemblies 172–178 are connected to the tractor hydraulic system and the parking stand associated with the dozer are retracted, whereupon the implement is ready for use. Detachment of the dozer from the tractor 12 involves a simple reversal of the foregoing connection sequence.

The dozer implement 14 is particularly designed to facilitate mounting thereof onto various sizes and types of tractors. To this end, the U-shaped portion 144 of the front cross assembly 124 is provided with the series of mating connection apertures 148 which are alignable with the apertures provided in the forward end arm plates 140, 142. Accordingly, the U-shaped portion 144, and the attached, depending tubular elements 146, can be vertically adjusted to accommodate various types and sizes of tractors; this factor, along with provision of the releasable connection afforded by the pins 159 coupling the rear push assembly 122 and the front cross assembly 124, allows the dozer to be mounted to tractors which require tilting of the loader for appropriate dig depth, all without extensive modifications to implement or tractor.

I claim:

1. In combination:

an assembly adapted to be affixed to a tractor and operable for quickly and alternately mounting first and second, different types of implements to the tractor, said assembly including a pair of elongated rails for securement to the forward end of said tractor on opposed sides thereof and extending fore and aft of the tractor; and bracket means for securement to the underside of said tractor in a position adjacent the rearward end of said tractor and approximal to the center thereof;

first and second, different implements each including a material handling element, a pair of elongated, laterally spaced apart connecting arms oriented for straddling the forward end of said tractor and engaging said rails, said connecting arms being in the form of respective channels for telescopically receiving corresponding adjacent rails, and means operatively connecting said arms to said element; and means for alternately and releasably coupling said first and second implements to at least certain portions of said assembly, including structure for releasably securing each of said arms to a corresponding adjacent rail, said second implement being a dozer, said element forming a part of said dozer comprising a dozer blade, said dozer including an elongated connection leg positioned between and below said connecting arms, the rearmost end of said leg being adapted for securement to said bracket means, said coupling means including structure for releasably securing said leg to said bracket means.

2. The combination of claim 1, said coupling means comprising structure defining pin-receiving apertures in said connecting arms and rails respectively, and pin means for insertion into said apertures for coupling of the arms to corresponding rails.

3. The combination of claim 1, said first implement being a loader, said element comprising a bucket, there being means operatively coupled to said bucket for raising and lowering thereof.

4. The combination of claim 1, said dozer including selectively actuatable motive means for pivoting movement of said blade about a horizontal and an upright axis respectively.

5. The combination of claim 1, said assembly further including laterally extending bracing means operatively coupled to said rails.

6. The combination of claim 1, each of said rails including a rearwardly extending bracing portion adapted for securement to the rear axle of said tractor.

* * * * *